US005611086A

United States Patent [19]

Eggen

[11] Patent Number: 5,611,086

[45] Date of Patent: Mar. 18, 1997

[54] NURSING GARMENT

[76] Inventor: Kathleen R. Eggen, 620 Shorewood La., Waterloo, Nebr. 68069

[21] Appl. No.: 643,329

[22] Filed: May 6, 1996

[51] Int. Cl.[6] ..... A41B 1/00; A41D 1/20; A41D 1/22

[52] U.S. Cl. ..... 2/104; 2/115; 2/102; 450/36; 450/37

[58] Field of Search ..... 2/73, 104, 105, 2/106, 113, 114, 115, 102; 450/30, 31, 32, 53, 154, 55, 56, 57, 36, 37

[56] References Cited

U.S. PATENT DOCUMENTS

| | | | |
|---|---|---|---|
| 206,906 | 8/1878 | Strauss . | |
| 778,014 | 12/1904 | Coyle . | |
| 1,136,727 | 4/1915 | Smith | 450/37 X |
| 2,911,650 | 8/1956 | Gerich | 2/74 |
| 4,004,294 | 1/1977 | Pinch | 2/104 |
| 4,031,566 | 6/1977 | Johnson | 2/104 |
| 4,164,228 | 8/1979 | Weber-Unger | 128/461 |
| 4,208,743 | 6/1980 | Whitcraft | 2/104 |
| 4,280,228 | 7/1981 | Sulzamann | 2/104 |
| 4,458,365 | 7/1984 | Wood | 2/104 |
| 4,663,782 | 5/1987 | Knox et al. | 2/104 |
| 4,700,699 | 10/1987 | Tollerud et al. | 128/156 |
| 4,875,492 | 10/1989 | Mitchell et al. | 128/890 |
| 5,149,336 | 9/1992 | Clarke et al. | 604/388 |
| 5,182,813 | 2/1993 | Booze | 2/104 |

FOREIGN PATENT DOCUMENTS

| | | | |
|---|---|---|---|
| 2030243 | 2/1993 | Australia | 2/104 |

*Primary Examiner*—Jeanette E. Chapman
*Attorney, Agent, or Firm*—Zarley, McKee, Thomte Voorhees & Sease; Mark D. Frederiksen

[57] ABSTRACT

A nursing garment includes a vest which is attached to an undergarment which covers the upper torso of a nursing mother. The undergarment has a pair of openings therein through which the mother's breasts will protrude to permit nursing of a baby. The vest includes a pair of flaps which may be selectively connected together to cover the breasts. A sheet of liquid impervious, air permeable material is attached to the rearward surface of each flap and oriented to cover the breasts. A cover sheet of liquid and air permeable material is attached over each sheet on the rearward surface of each flap to form a pocket between the cover sheet and sheet on each flap. A pad of liquid absorbent material is removably inserted in each pocket to absorb liquid which may leak from the nursing mother's breasts.

12 Claims, 1 Drawing Sheet

NURSING GARMENT

TECHNICAL FIELD

The present invention relates generally to nursing garments, and more particularly to an improved blouse suitable for use as a sleeping gown by a nursing mother.

BACKGROUND OF THE INVENTION

A mother who is breast feeding a child frequently will have fluid which leaks from the breasts during the night. This fluid leakage is absorbed by the sleeping garment, and can become uncomfortable, can be absorbed by the bedding, and may be potentially irritating to the skin so as to cause a rash.

One solution to this problem that has been found in the prior art is in the use of either disposable or washable pads which fit within a nursing and maternity bra cup. Another prior art device incorporates a bra within a gown itself. However, both of these devices force the nursing mother to wear the nursing brassiere, or similar constricting apparel to bed.

SUMMARY OF THE INVENTION

It is therefore a general object of the present invention to provide a garment for nursing mothers which permits the mother to rest or sleep without wearing a maternity bra, or a gown with a bodice which fastens like a bra.

Another object of the present invention is to provide a garment for a nursing mother with removable absorbent pads for absorbing fluid leakage from the breasts.

Still another object of the present invention is to provide a garment for nursing mothers which is simple and economical to manufacture, comfortable to wear, and refined in appearance.

These and other objects will be apparent to those skilled in the art.

The nursing garment of the present invention includes a vest which is attached to an undergarment which covers the upper torso of a nursing mother. The undergarment has a pair of openings therein through which the mother's breasts will protrude to permit nursing of a baby. The vest includes a pair of flaps which may be selectively connected together to cover the breasts. A sheet of liquid impervious, air permeable material is attached to the rearward surface of each flap and oriented to cover the breasts. A cover sheet of liquid and air permeable material is attached over each sheet on the rearward surface of each flap to form a pocket between the cover sheet and sheet on each flap. A pad of liquid absorbent material is removably inserted in each pocket to absorb liquid which may leak from the nursing mother's breasts.

DESCRIPTION OF THE PREFERRED EMBODIMENT

Figure 1:
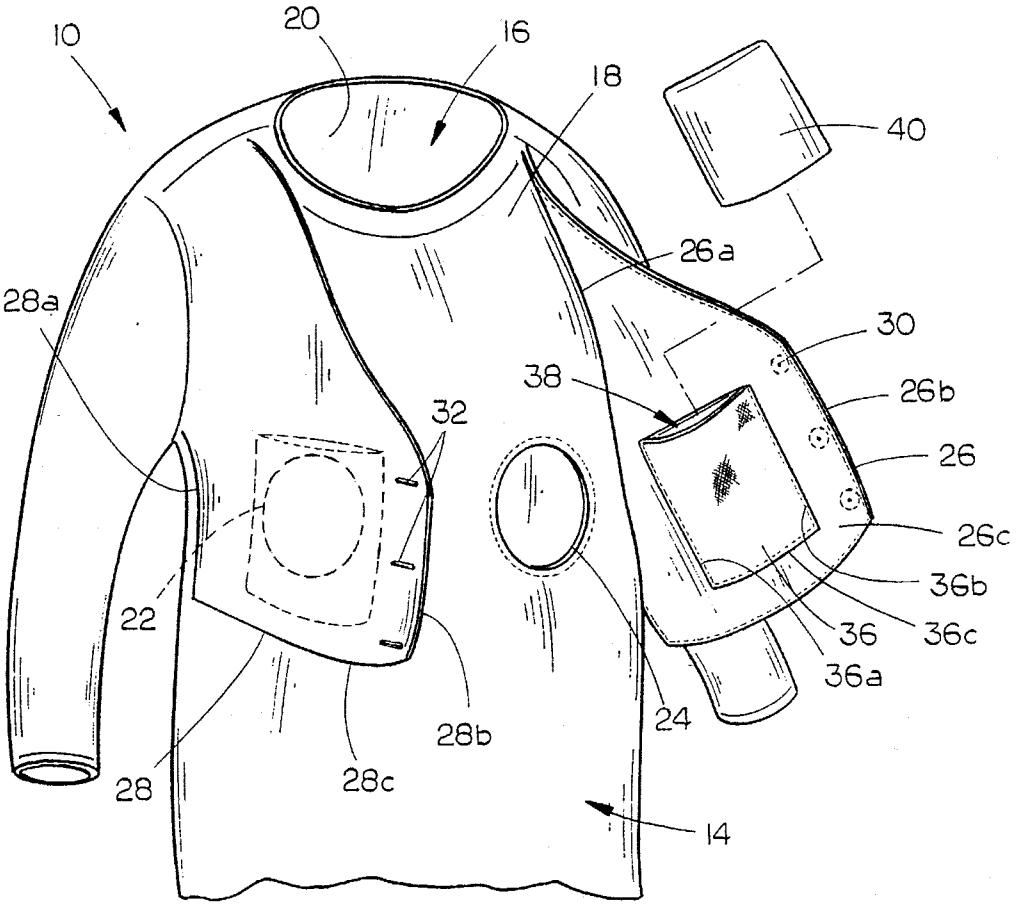
FIG. 1 is a pictorial view of the garment of the present invention.

Referring now to the drawings, in which similar or corresponding pads are identified with the same reference numeral, and more particularly to FIG. 1, the nursing garment of the present invention is designated generally at 10.

Nursing garment 10 includes a vest portion 12 attached to an undershirt 14, the undershirt 14 having a head opening 16 at an upper end thereof, a forward panel 18 and a rearward panel 20. Forward panel 18 of undershirt 14 has a pair of spaced apart openings 22 and 24 formed therein through which the mother's breasts will protrude for nursing a baby.

Vest portion 12 includes a right flap 26 and a left flap 28 each attached to undershirt 14 along first side edges 26*a* and 28*a* respectively. First edges 26*a* and 28*a* are located generally diametrically, such that the opposing second edges 26*b* and 28*b* of each flap will be arranged in overlapping orientation to permit them to be fastened together with buttons 30 cooperable with buttonholes 32. When fastened together, flaps 26 and 28 will cover openings 24 and 22 respectively in undershirt 14.

Figure 2:
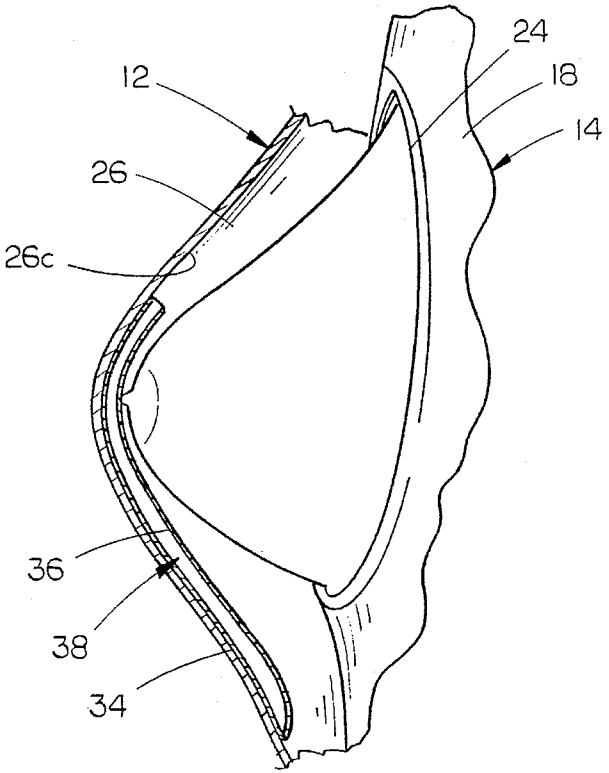
FIG. 2 is an enlarged sectional view taken at lines 2—2 in FIG. 1.

Referring now to FIGS. 1 and 2, flap 26 has an elongated, generally rectangular sheet 34 of liquid impermeable air permeable material, such as that sold under the brand name HYTEX™, affixed to the rearward face 26*c* thereof. Sheet 34 is oriented generally vertically so as to extend downwardly below the lower extent of opening 24, and generally centered over opening 24 when flap 26 is fastened to flap 28. Sheet 34 thereby prevents the absorption of liquid which may leak from the breasts into the fabric of flap 26.

A cover sheet 36 formed of a fluid permeable material which dries quickly after contact with liquid, is attached to the rearward face 26*c* of flap 26 and extends over the entirety of sheet 34. A guinea worm material is one material which is known to provide the characteristics of quick-drying fibers but which permit the passage of moisture therethrough, such that the material against the skin is dry. Cover sheet 36 is fastened along side edges 36*a* and *b* and bottom edge 36*c* so as to form a pocket 38 between sheet 34 and cover sheet 36, with an open upper end. A generally rectangular pad 40 has dimensions which permit insertion within pocket 38, and is formed of a liquid absorbent material, so as to absorb liquid which passes from the breasts through cover sheet 36. Pad 40 is removable from pocket 38, permitting replacement of the pad as needed. Preferably, the fibers which make up cover sheet 36 are substantially liquid non-absorbent, such that liquid will pass through the openings in cover sheet 36 and be absorbed directly into pad 40. Cover sheet 36 remains substantially dry, thereby providing a dry sheet of fabric between the skin and the wet pad 40. Pad 40 may either be of the disposable type, or formed of a durable and washable material, such as cotton.

Although not described in detail herein, a substantially identical sheet 34', cover sheet 36', and pocket 38' are fastened to the rearward surface 28*c* of flap 28, so as to cover opening 22 in undershirt 14 when flaps 26 and 28 are fastened together.

Whereas the invention has been shown and described in connection with the preferred embodiment thereof, it will be understood that many modifications, substitutions and additions may be made which are within the intended broad scope of the appended claims. For example, while the nursing garment 10 is shown with both a best portion 12 and an undershirt 14, the vest portion 12 would function equally as well without the undershirt port 14. Thus, the garment could be in the form of a vest portion 12 alone.

Similarly, the specific types of fasteners used to connect flaps 26 and 28, are not critical to the invention, and other equivalent fasteners could be used in place thereof. In addition, while the vest is described as having a sheet 34 attached thereto formed of an air breathable water impermeable material, the entire flap could be formed of this material instead of attaching a sheet to a flap of a separate material.

I claim:

1. A garment for nursing mothers, comprising:

a vest for clothing an upper torso of a nursing mother, the vest having right and left selectively connectable flaps arranged to cover right and left breasts, respectively, of a wearer when the flaps are connected;

each of said flaps having a region thereon formed of an air permeable, liquid impermeable material, each said region extending vertically and horizontally a distance to cover the wearer's breast which is adjacent the flap; each of said vest flaps being formed of fabric;

each of said flaps having a cover sheet attached to a rearward surface thereof, interposed between the flap and the wearer, each said cover sheet extending across the vertical and horizontal extent of said region;

each said region of the flaps including a sheet of liquid impermeable, air permeable material attached to the fabric of the vest flaps;

each said cover sheet formed of a fluid permeable material and extending the length and width of said liquid impermeable, air permeable sheets;

the sheets having a length and width less than the length and width of the flaps; and a pad interposed between each cover sheet and adjacent region, each said pad formed of a liquid absorbent material.

2. The garment of claim 1, wherein each said cover sheet is formed of a material having generally liquid nonabsorbent strands.

3. The garment of claim 2 wherein each said cover sheet has a pair of opposing vertical side edges and a bottom edge which are continuously attached to the liquid impermeable, air permeable sheet to form a pocket with an opening along an upper edge of the cover sheet.

4. The garment of claim 3, wherein each said pad has dimensions permitting slidable insertion and removal from each pocket.

5. The garment of claim 4, wherein each said pad is formed of a durable, washable fabric.

6. The garment of claim 5, further comprising an undergarment attached to the vest for clothing the upper torso of a nursing mother, the undergarment located between the vest and the skin of the wearer, said undergarment having a pair of openings in a front panel thereof through which the breasts of the wearer will protrude for nursing a baby.

7. The garment of claim 6, wherein said vest flaps are attached to the undergarment generally diametrically.

8. The garment of claim 7, further comprising fastener means for selectively connecting the right and left flaps together.

9. The garment of claim 1, wherein each said cover sheet has a peripheral edge which is continuously attached to the sheet and flap for less than the entire length of the peripheral edge, to form a pocket between the cover sheet and sheet with an opening along an unattached portion of the cover sheet.

10. The garment of claim 9, wherein each said pad has dimensions permitting slidable insertion and removal from each pocket.

11. The garment of claim 10, further comprising an undergarment attached to the vest for clothing the upper torso of a nursing mother, the undergarment located between the vest and the skin of the wearer, said undergarment having a pair of openings in a front panel thereof through which the breasts of the wearer will protrude for nursing a baby.

12. The garment of claim 11, wherein said vest flaps are attached to the undergarment generally diametrically.

* * * * *